US008250787B1

(12) United States Patent
Sawyer

(10) Patent No.: US 8,250,787 B1
(45) Date of Patent: Aug. 28, 2012

(54) METHOD FOR POST REMOVAL INCLUDING CONCRETE FOOTING REMOVAL

(76) Inventor: Daniel Sawyer, Pflugerville, TX (US)

( * ) Notice: Subject to any disclaimer, the term of this patent is extended or adjusted under 35 U.S.C. 154(b) by 195 days.

(21) Appl. No.: 12/714,469

(22) Filed: Feb. 27, 2010

(51) Int. Cl.
*E02F 1/00* (2006.01)

(52) U.S. Cl. ..... 37/466

(58) Field of Classification Search ..... 37/317, 37/322, 323, 318, 321, 195, 466, 468; 406/88, 406/96, 157–162; 405/163, 333, 262
See application file for complete search history.

(56) References Cited

U.S. PATENT DOCUMENTS 4,106,299 A * 8/1978 Fujii ..... 405/303
5,212,891 A * 5/1993 Schuermann et al. ..... 37/323
5,966,847 A * 10/1999 Nathenson et al. ..... 37/347
6,470,605 B1 * 10/2002 Gilman et al. ..... 37/323

* cited by examiner

*Primary Examiner* — Robert Pezzuto

(57) ABSTRACT

One embodiment of an improved method for removing a post from the ground, the method including inserting a spike tool into the ground around the perimeter of the base of the post, reducing the lifting force required by creating a layer of reduced friction mud surrounding the base of the post, supplying of pressurized fluid through the spike tool to the base of the post within the ground, and neutralizing the suction force created when the post is lifted from the ground.

1 Claim, 6 Drawing Sheets

METHOD FOR POST REMOVAL INCLUDING CONCRETE FOOTING REMOVAL

BACKGROUND

Prior Art

The following is a tabulation of some prior art that presently appears relevant:

| U.S. Patents | | | |
|---|---|---|---|
| Pat. No. | Kind Code | Issue Date | Patentee |
| 4,250,769 | | Feb. 17, 1981 | Herring |
| 5,186,437 | | Feb. 16, 1993 | Scott |
| 6,398,188 | B1 | Jun. 4, 2002 | Salman |
| 6,527,250 | B1 | Mar. 4, 2003 | Tyson |
| 7,059,587 | B1 | Jun. 13, 2006 | Fimple |
| 5,611,587 | | May 18, 1997 | Brown |

Many items are supported or secured through the application of one or more posts placed into the ground. Such items include residential privacy fences, mailboxes, signs, and other items. Posts are commonly made of metal or wood, but may be of plastic or other material. The post may take several forms including a single piece with the load carrying portion placed directly into the ground, or the post may consist of two or more pieces including an anchor placed into the ground with the load carrying section attached to the anchor. In some applications, the section placed into the ground may be encased in a concrete footing or base. For the purposes of this application, the term "post" will be used to refer to the entirety of the assembly, including the post, post anchor, and concrete footing. At times, it is necessary to remove, replace or relocate the post. It then becomes necessary to remove the post from the ground. The removal of such post can be quite difficult.

It is sometimes possible to manually remove a post. Sometimes the post can be loosened by striking it from different angles with a sledge hammer and then lifting and pulling on the post to remove it from the ground. Alternatively, the post may be excavated by digging around the post to a depth sufficient to remove the post. Soaking the ground with water can help to loosen the ground. The sledge hammer method and the digging method are both labor intensive.

The prior art contains many mechanical devices proposed for pulling and removing posts. The apparatus in U.S. Pat. No. 4,250,769 to Herring (1981), and the apparatus in U.S. Pat. No. 5,186,437 to Scott (1993), both utilize a fulcrum and lever arm to increase the lifting force applied to the post. Similarly, the post puller in U.S. Pat. No. 6,398,188 to Salman (2002), and the device in U.S. Pat. No. 6,527,250 to Tyson (2003), both increase the mechanical advantage applied to the post by using hydraulic cylinders or a jack.

Other prior art proposes devices for increasing the grip on the post or object during the lifting process. U.S. Pat. No. 7,059,587 to Fimple (2006), and U.S. Pat. No. 5,611,587 to Brown (1997), both describe devices that provide advantages in gripping various objects, allowing more lifting force to be applied.

These representative prior art devices are limited to removing posts where the lifting force applied is sufficient to overcome the friction force holding the post in the ground. Further, several of the prior art devices are expensive or heavy devices. All of the devices and methods heretofore known for the purpose of removing a post from the ground suffer from a number of disadvantages:

(a) If water is used to soften the ground, I have found that it can take several hours for the water to penetrate the ground to reach the bottom of the post and can result in significant runoff and water use. Further, I have found that the addition of the water to the ground can result in suction force resisting the upward movement of the post which increases the required force to remove the post from the hole.

(b) I have found that the mechanical lifting force applied to posts by means of lever arm, jack, or hydraulic cylinder, can be insufficient to lift the post from the ground in some situations. For example, when the post is set in heavy clay ground or when the post is set deep into the ground.

(c) I have found that the gripping ability of the device used on the post can be insufficient to lift the post from the ground.

(d) I have found that the forces applied during the use of the mechanical lifting and gripping devices can cause mechanical failure of the device or failure of the post, resulting in potentially hazardous release of energy that can injure a worker.

SUMMARY

One embodiment provides a method for post removal from the ground, the method including inserting a spike tool into the ground at periodic spacing around the perimeter of the post to a depth matching that of the post, flowing water through the spike tool during the insertion process to create a layer of low-friction mud, leaving the spike tool inserted into the ground during the lifting process, applying pressurized water through the spike tool to counteract the suction force created and create positive pressure below the post within the hole to assist in removal of the post during the lifting process.

ADVANTAGES

Accordingly several advantages of one or more aspects are as follows: to provide a method for post removal from the ground that reduces the friction force between the post and the ground, that neutralizes the suction force when removing the post from the hole, that conserves water, that utilizes relatively inexpensive equipment, that requires relatively low force to remove the post from the ground, that leaves a clean hole ready for the replacement post, that works in heavy clay ground types, that can remove posts that are set greater than 2 feet into the ground, that can be operated with relatively low skill and low physical strength, and that can remove a post in a short amount of time. Other advantages of one or more aspects will be apparent from a consideration of the drawings and ensuing description.

DRAWINGS

Figures

In the drawings, closely related figures have the same number but different alphabetic suffixes. For a better understanding of the invention, and to show by way of example how the same may be carried into effect, reference is now made to the detailed description of the invention along with the accompanying figures in which corresponding numerals in the different figures refer to corresponding parts and in which.

Figure 1:
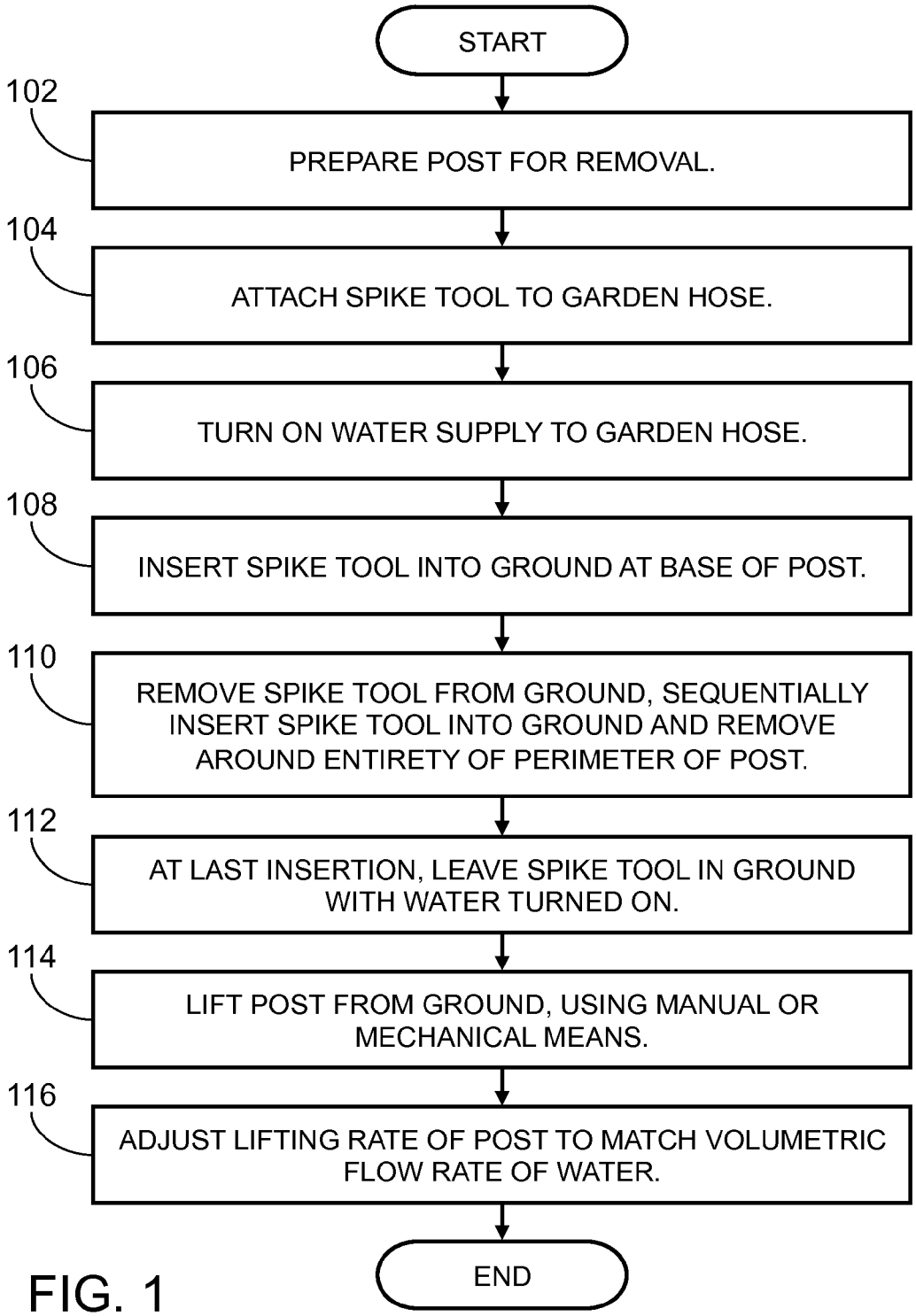
FIG. 1 illustrates a flow chart of a post removal process in accordance with one embodiment.

| Drawings—Reference Numerals | |
|---|---|
| 102 | Post preparation step |
| 104 | Spike tool connection to garden hose step |
| 106 | Activation of water supply to garden hose step |
| 108 | Spike tool insertion into ground at base of post step |
| 110 | Removal of spike tool from ground, sequentially repeating insertion and removal around perimeter of post step. |
| 112 | Leave spike tool in ground with water turned on step. |
| 114 | Lift post from ground step. |
| 116 | Adjust lifting rate to match volumetric flow rate of water step. |
| 118 | Post |
| 120 | Concrete footing |
| 122 | Ground |
| 124 | Spike tool |
| 126 | Layer of ground mixed with fluid |
| 128 | Fluid |
| 130 | Hole |
| 132A to 132G | Spike tool insertion points into ground |

DETAILED DESCRIPTION OF THE INVENTION

FIG. 1 illustrates a flow chart of a post removal process. In one embodiment, a post is freestanding with attached structure removed and a work area is cleared around the post (step 102). A spike tool, such as a Tree & Shrub Aerator Model 130T available from Young Products, Inc. of Suisun Calif., is connected to a garden hose (step 104). However, the spike tool can be of many different designs and made of any rigid material that is hollow and capable of insertion into the ground. Pressurized water, or other fluid, is supplied to the spike tool (step 106) and the spike tool is inserted into the ground to a depth matching that of the post (step 108). The spike is repeatedly inserted into the ground and removed around the entirety of the perimeter of the post (step 110), thereby encasing the section of the post that is below grade level in a layer of mud, or loosened ground, or mixture of fluid and ground. With the spike inserted into the ground to the depth of the post and the water supply turned on (step 112), the post is lifted from the hole (step 114). The lifting rate of the post is varied to match the volumetric flow rate of the water through the spike tool (step 116), thereby neutralizing the suction force drawing the post back into the hole. In various embodiments, one or more of steps 102, 110, 112, 116 may be omitted, according to the implementation.

Figure 2A:
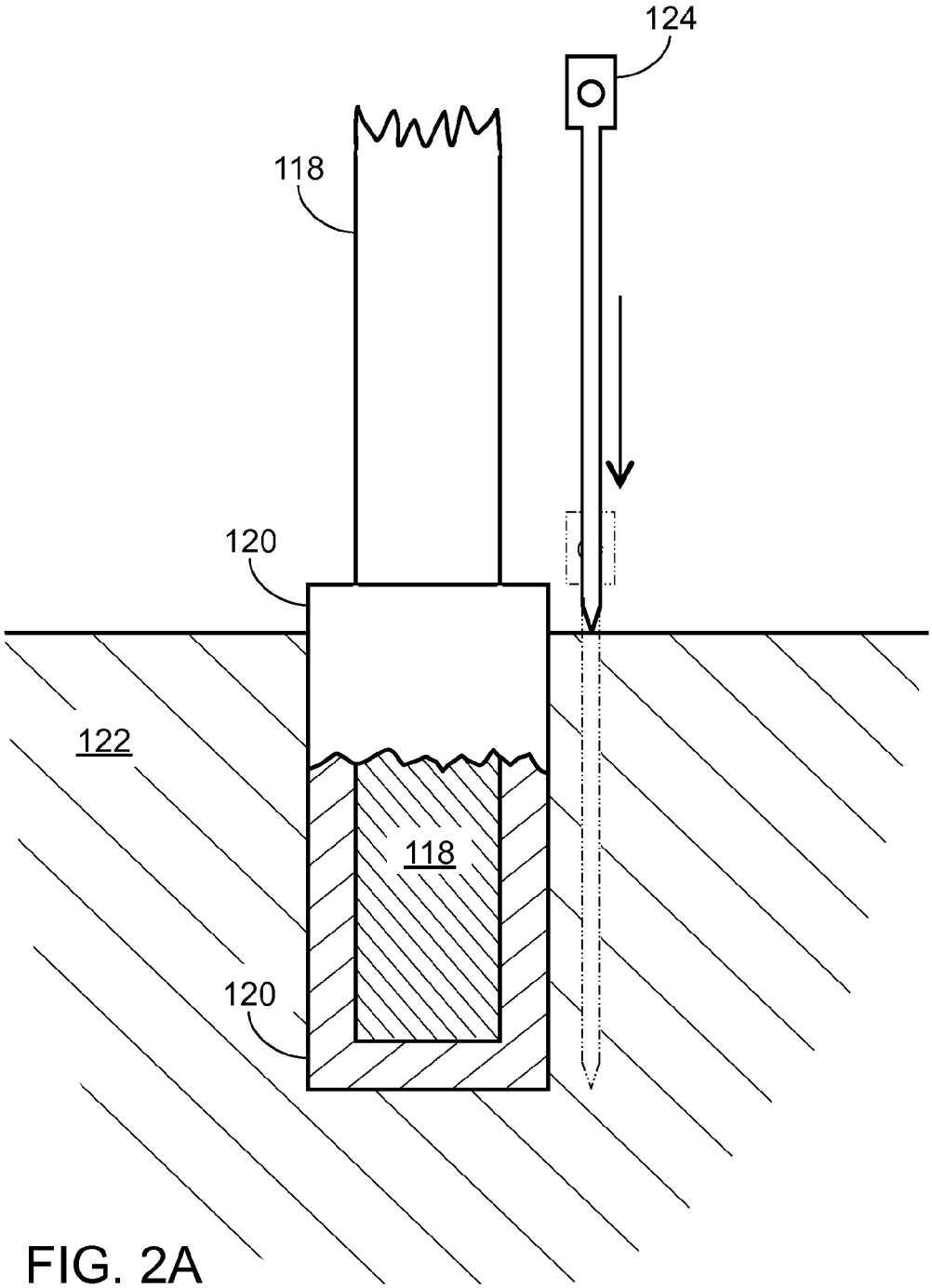
FIGS. 2A to 2C show various aspects of the creation of a low-friction mud layer between the ground and the post in accordance with one embodiment.
Figure 2B:
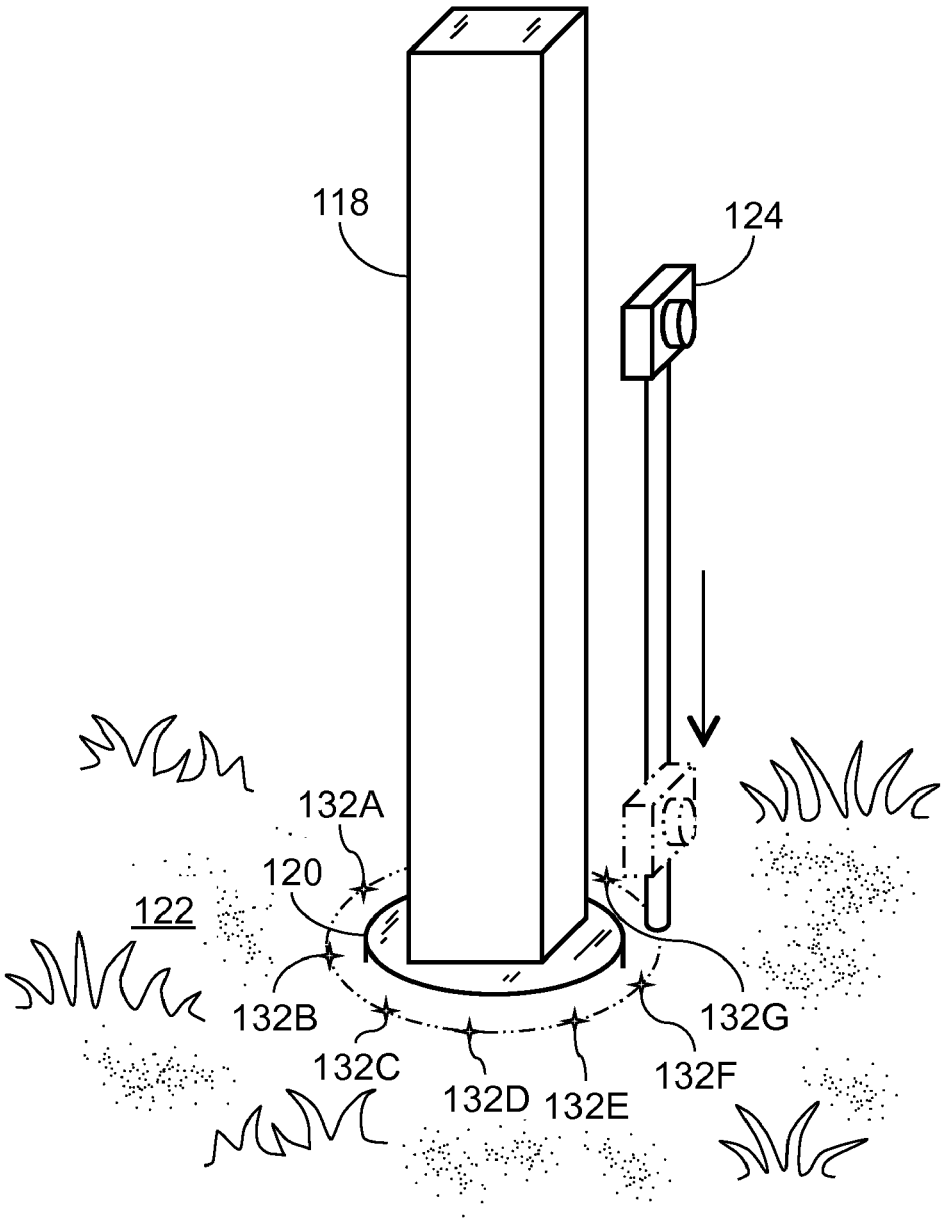
Figure 2C:
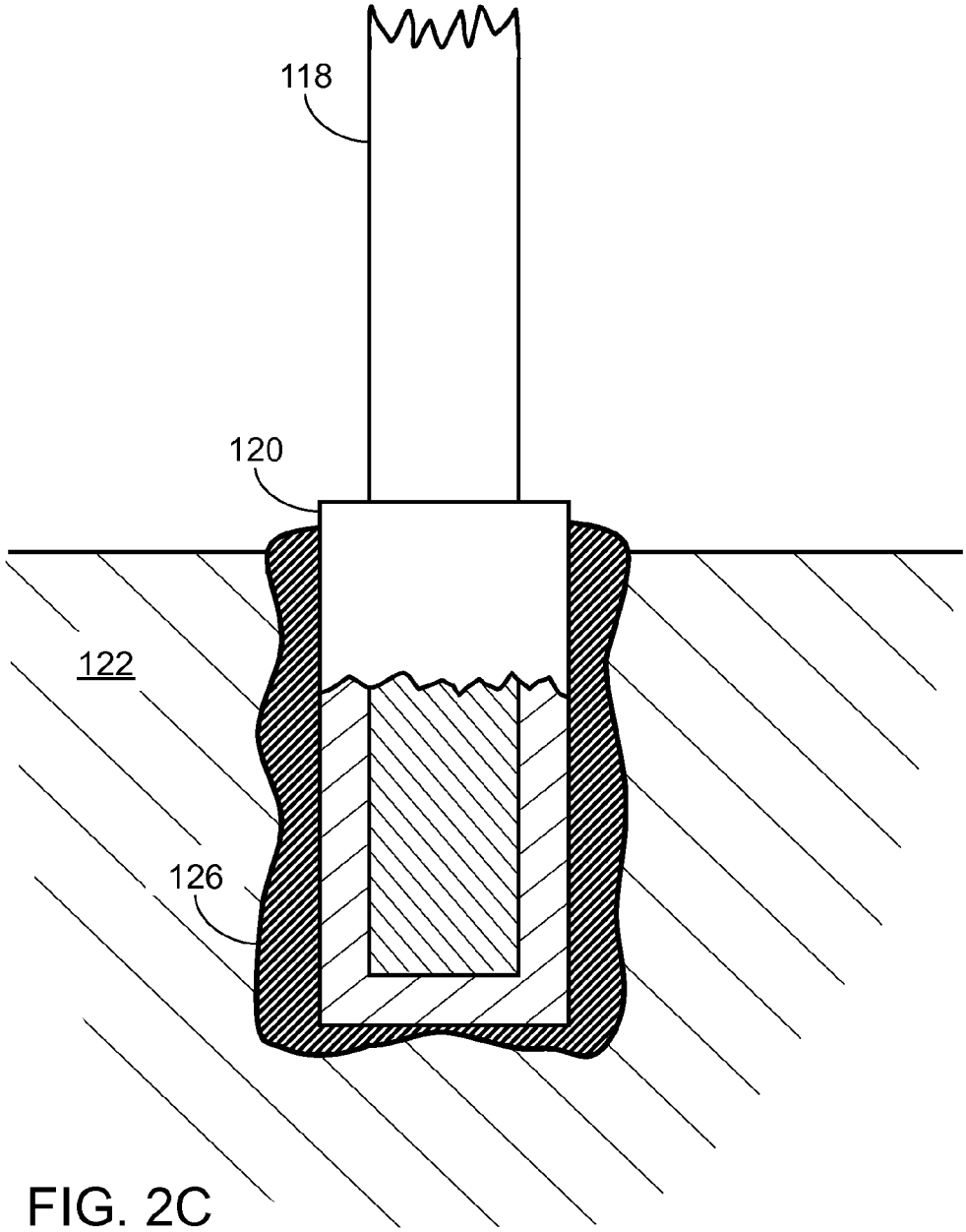

FIG. 2A and FIG. 2B and FIG. 2C depict the formation of a layer of reduced friction mud surrounding the post. In one embodiment, the action of the pressurized water from the spike tool combines with the force used to insert the spike tool into the ground, thereby loosening the ground and reducing the friction with the formation of the mud layer surrounding the post. Spacing of the spike tool insertions around the perimeter of the post can be varied to account for different ground conditions. Difficult ground conditions, such as clay ground or compacted ground, will require tighter spacing and more insertions of the spike tool.

FIG. 2A illustrates a post 118 with a concrete footing 120 set in ground 122. A spike tool 124 is inserted into the ground 122 to the depth of the post 118 and the concrete footing 120.

FIG. 2B illustrates the insertion of the spike tool 124 into the ground 122 at locations 132A, 132B, 132C, 132D, 132E, 132F, 132G around the perimeter of the post 118 and the concrete footing 120. The spacing and number of the insertion locations can be varied according to soil conditions within the ground 122.

FIG. 2C illustrates a resulting layer of ground mixed with fluid 126 at the completion of the process. The layer of ground mixed with fluid 126 surrounding the concrete footing 120 and post 118 is of lower friction that the ground 122 itself.

Figure 3A:
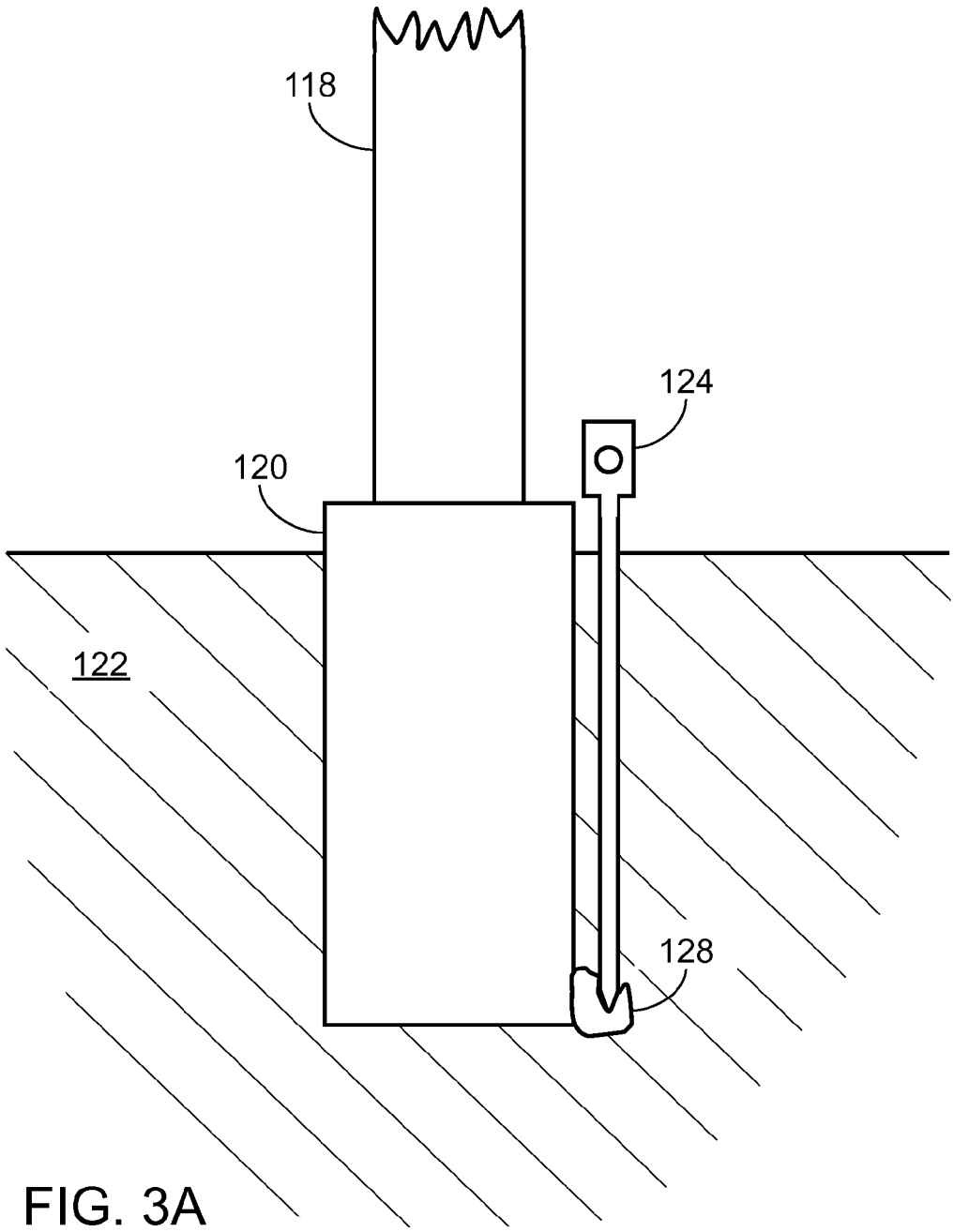
FIGS. 3A to 3B show various aspects of the neutralization of suction force and the creation of lifting force within the hole to assist in removal of the post in accordance with one embodiment.
Figure 3B:
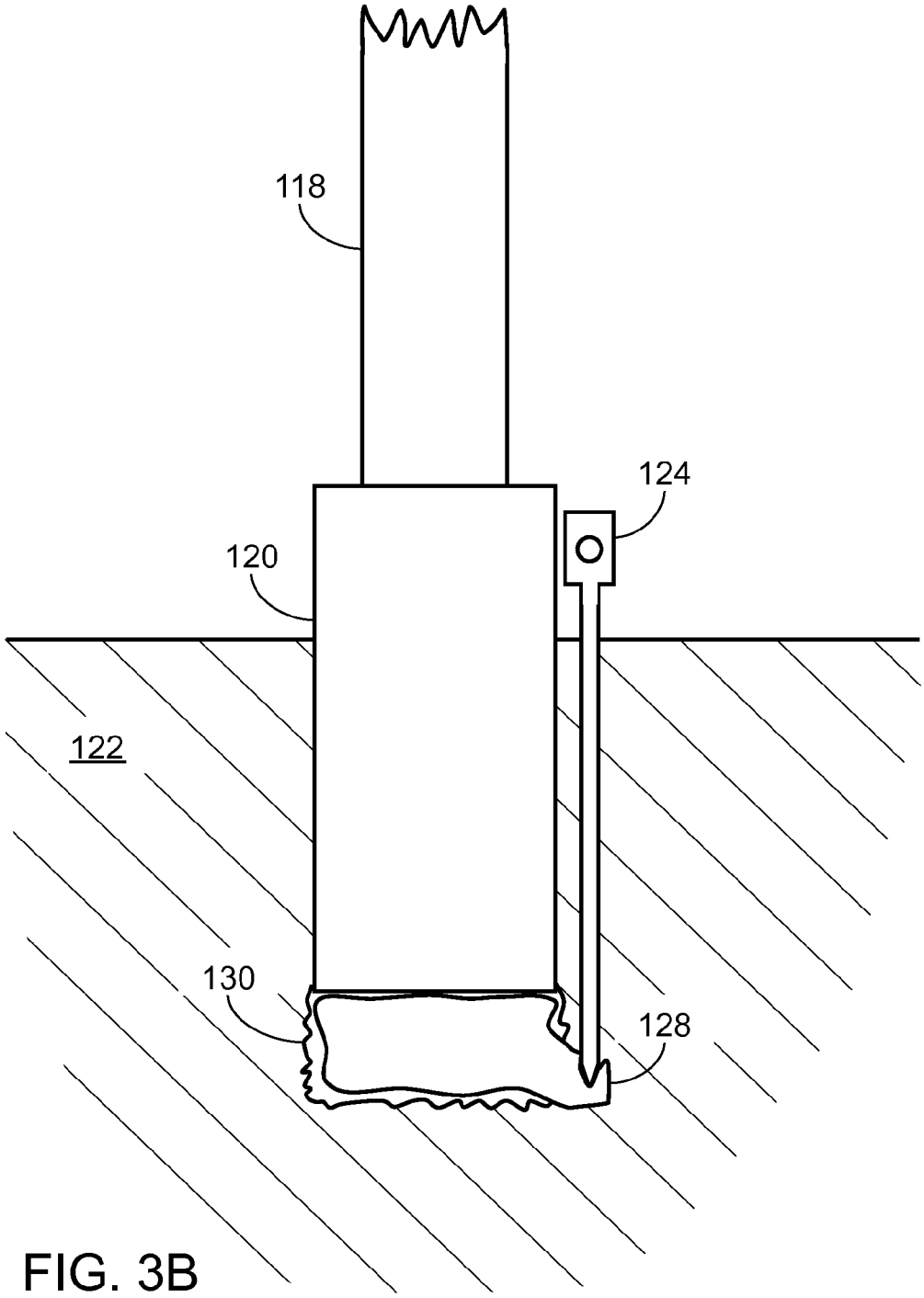

FIG. 3A and FIG. 3B depict neutralization of a suction force created as the post is lifted from the hole. The ground surrounding the post can form an airtight seal, leading to the suction force that opposes the upward motion of the post. In one embodiment, the spike tool delivers pressurized water to the base of the post, thereby neutralizing the suction force as the post is lifted from the hole. In some cases, the pressurized water delivered to the base of the post can generate a lifting force that assists in the removal of the post from the ground. The lifting force can be increased by reducing the amount of water that leaks to the surface, either by plugging the leaks with a non-porous material or by simply compressing the top layer of ground in the leak locations.

FIG. 3A illustrates a pocket of fluid 128 formed at the tip of the spike tool 124 inserted into the ground 122. The fluid 128 is in contact with the concrete footing 120 of the post 118.

FIG. 3B illustrates the situation after the post 118 and concrete footing 120 is lifted partway from a hole 130. As the post 118 and concrete footing 120 are lifted, the fluid 128 will fill the hole 130 and neutralize the suction force created from the lifting action.

ADVANTAGES

From the description above, a number of advantages of some embodiments of my post removal method become evident:

(a) The use of the aeration spike and pressurized water can create a layer of reduced friction mud surrounding the post and reducing the lifting force required to remove the post from the ground.

(b) The use of pressurized water delivered to the bottom of the post can neutralize the suction force that can be created as the post is lifted from the hole.

(c) The use of sealing the leaking locations during the use of pressurized water to the bottom of the post can generate lifting force in the bottom of the hole that assists in the removal of the post.

(d) The equipment used is relatively inexpensive.

(e) The method can remove a plurality of post and post footing designs.

(f) The removal of the post from the ground can be accomplished with relatively little additional force than that required to lift the weight of the post.

(g) The method can result in an empty hole that is clean and ready for the replacement post.

(h) The method can remove a post from a plurality of ground types, including heavy clay.

(i) The method can remove posts that are set at a plurality of depths, including posts that are set greater than two feet into the ground.

(j) The method can remove a post from the ground in a relatively short amount of time.

CONCLUSION, RAMIFICATIONS, AND SCOPE

Accordingly, the reader will see that the post removal method of the various embodiments can reduce friction between the post and the ground, can neutralize the suction force when removing the post from the hole, can conserve water, can utilize relatively inexpensive equipment, can remove a post from the ground using relatively low force, can leave a clean hole ready for the replacement post, can work in heavy clay ground types, can remove posts that are set greater than 2 feet into the ground, can be operated with relatively low skill and low physical strength, and can remove a post in a relatively short amount of time.

Although the description above may contain specificities, these should not be construed as limiting the scope of the embodiments but as merely providing illustrations of some of several embodiments. For example, the fluid used to reduce the friction between the ground and the post can be other than water, such as air, slurry, lubricating oils, etc.; the fluid used to neutralize the suction force as the post is removed from the ground can be other than water, such as air, slurry, lubricating oil, etc.; the fluid used to reduce friction and the fluid used to neutralize the suction force can be the same fluid or different fluids; the method used to neutralize the suction force can be to supply pressurized fluid, to provide an open pathway through the spike tool, or to create a pathway through the ground by the action of inserting and removing the spike tool, etc.

Thus the scope of the embodiments should be determined by the appended claims and their legal equivalents, rather than by the examples given.

What is claimed is:

1. A method for removing a post from the ground, comprising:

a. providing a spike tool which is able to insert into said ground to depth of said post b. providing a supply of pressurized fluid to said spike tool c. introducing said spike tool into said ground to depth of said post at one location or a plurality of locations at perimeter of said post d. flowing said pressurized fluid through said spike tool to base of said post e. controlling flow velocity of said pressurized fluid so as to prevent excavation of said ground f. forming a seal between surface of said ground and said post and said spike tool g. mixing of said fluid with said ground at boundary of said post with said ground to form a low-friction fluidized layer h. continuing flow of said pressurized fluid during lifting operation of said post to neutralize suction force and generating positive lifting pressure force to bottom of said post i. lifting the post from the ground using levers or other mechanical advantage mechanisms whereby the post is removed from the ground and leaving a hole with a clean boundary that is substantially equal to the dimension of the post that was removed, with no significant excavation or displacement of the ground around the post.

* * * * *